United States Patent [19]

Bridges

[11] 4,131,203

[45] Dec. 26, 1978

[54] WALL MOUNTED MODULAR UNITS

[75] Inventor: John A. Bridges, Nashville, Tenn.

[73] Assignee: Aladdin Industries, Incorporated, Chicago, Ill.

[21] Appl. No.: 759,067

[22] Filed: Jan. 13, 1977

[51] Int. Cl.[2] ..... A47F 3/14; A47F 5/08

[52] U.S. Cl. ..... 211/88; 108/32; 211/126; 220/4 E

[58] Field of Search ..... 211/88, 90, 126, 71; 108/27, 32, 152; 220/23.4, 18, 17, 4 E, 4 B, 4 F, 4 D, 23

[56] References Cited

U.S. PATENT DOCUMENTS

| | | | |
|---|---|---|---|
| 2,702,649 | 2/1955 | Neilson | 211/71 x |
| 2,730,263 | 1/1956 | Neilson | 220/18 |
| 3,033,378 | 5/1962 | Delhardt et al. | 211/126 |
| 3,252,614 | 5/1966 | Evans | 211/126 X |
| 3,360,152 | 12/1967 | Leers | 220/4 E X |
| 3,613,604 | 10/1971 | Butler | 108/32 X |
| 3,661,271 | 5/1972 | Fisher et al. | 211/88 |
| 3,670,872 | 6/1972 | Rock et al. | 220/4 B X |
| 3,734,526 | 5/1973 | Propst et al. | 211/126 X |
| 3,791,528 | 2/1974 | Brendgord | 211/88 |
| 3,908,831 | 9/1975 | Brendgord | 211/126 X |
| 3,952,903 | 4/1976 | Sanders et al. | 220/4 E |
| 3,983,976 | 10/1976 | Taylor | 220/18 X |

FOREIGN PATENT DOCUMENTS

| | | |
|---|---|---|
| 2447907 | 4/1976 | Fed. Rep. of Germany. |
| 7619537 | 6/1976 | Fed. Rep. of Germany. |
| 7626365 | 8/1976 | Fed. Rep. of Germany. |

*Primary Examiner*—Roy D. Frazier
*Assistant Examiner*—Terrell P. Lewis

[57] ABSTRACT

Modular units for mounting on vertical surfaces such as walls are provided which are mounted by engaging a tongue in the upwardly opening channel of the elongated bar, which bar extends into a recess provided in the units.

9 Claims, 5 Drawing Figures

WALL MOUNTED MODULAR UNITS

BACKGROUND OF THE INVENTION

This invention relates generally to improvements in article supporting means, more specifically, it relates to improvements in modular units to be mounted on vertical surfaces.

A common problem in many environments, such as kitchens, workbenches, desks and hospital beds for instance, is providing means for supporting numerous articles of different shapes and sizes while at the same time keeping them accessible and providing convenient access. For instance, telephones, food items (staples such as sugar, flour, bread or spices), stationery items (such as note pads, pens, pencils or business forms), appliances (such as mixers, toasters, tools or ashtrays), indeed an almost endless list of small and medium size articles that people need or find convenient at one time or another. Very frequently the environment, such as those named, provide a flat surface which cannot be used because that surface is required to accomplish the work, whatever it may be, i.e., cooking, office work, repairs or the carrying out of a hobby.

Many times the work surface is adjacent or in proximity to the vertical surface such as a wall, and there are numerous devices provided for mounting supports of one kind or another on the wall. However, those devices of which the applicant is aware are generally designed for use in very specific situations so that shelving or the like that is suitable for use in connection with a workbench is not suitable for use in a kitchen or at a desk. Likewise, there are various kinds of article storage means which themselves use or render unusable the work surface.

Therefore, it is an object of this invention to provide a novel modular article supporting means which can find utility in a wide variety of environments.

It is another object of this invention to provide a novel modular article supporting means which can be easily installed by a user and can be easily modified as the need requires.

A further object of this invention is to provide a novel modular article supporting means which can be designed in various ways so as to accommodate a large variety of articles of different shapes and sizes.

It is a still further object of this invention to provide an article modular supporting means which is relatively inexpensive to manufacture.

BRIEF SUMMARY OF THE INVENTION

The foregoing and other objects are achieved by providing article supporting units having article supporting surfaces and simple means for interengaging with an elongated bar which may be secured to a vertical surface whereby the article supporting means may be easily mounted on or removed from the vertical surface and positioned along the vertical surface as desired by the user.

BRIEF DESCRIPTION OF THE DRAWING

The invention itself is set forth in the claims appended hereto and forming a part of this specification, while an understanding of embodiments thereof may be had by reference to the detailed description taken in conjunction with the drawing in which:

DETAILED DESCRIPTION

Figure 5:
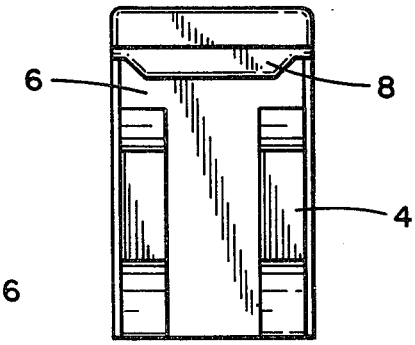
FIG. 5 is a view along the line 5—5 of FIG. 4.

Article supporting units in accordance with the invention comprise an upper surface 2 on which the article, whatever it may be, is supported. Extending from the upper surface is a back surface 4 in which is formed a recess 6. As may best be seen in FIG. 5, the recess 6 can extend transversely over the width of the unit. Extending downwardly over a portion of the recess is a tongue 8.

In order to mount a modular unit in accordance with the invention on a vertically extending surface such as a wall, there is provided an elongated bar 10 which can be secured to the vertically extending surface 11 by any suitable means such as the threaded fastener 12. Obviously other means of attaching the bar 10 could be used, as, for instance, an adhesive. Provided in the bar 10 is an upwardly opening channel 14 for receiving the tongue 8 (see FIGS. 2 and 4).

When it is desired to mount a unit on a wall or the like, the tongue 8 is engaged in the channel 14 by lowering it therein and a bottom part 4' of the back surface 4 then extends below the channel 10 and rests against the vertical surface 11. In this manner the modular unit extends from the surface 11 and is supported in a cantilevered fashion.

It is contemplated that the modular units can be formed of any suitable materials such as plastic, metal or wood. It is further contemplated that with respect to their design details, they can be designed in a large variety of ways with the following objectives in mind: the nature of the article or articles to be supported, the physical strength, the requirements of the material utilized and esthetic considerations. In the embodiment as shown, plastic is illustrated as the desired material, and it has been found convenient to form the modular unit as essentially hollow and therefore a lightweight device. In this embodiment there is provided an addition to the upper surface 2 and back surface 4, a front surface 16 and a bottom 18, thereby providing a lightweight mechanically strong unit which can be economically made.

In addition it is generally desirable to provide retaining walls 20 extending upwardly from the surface 2 to maintain the articles being supported separate from each other and to prevent their undesired movement.

Figure 1:
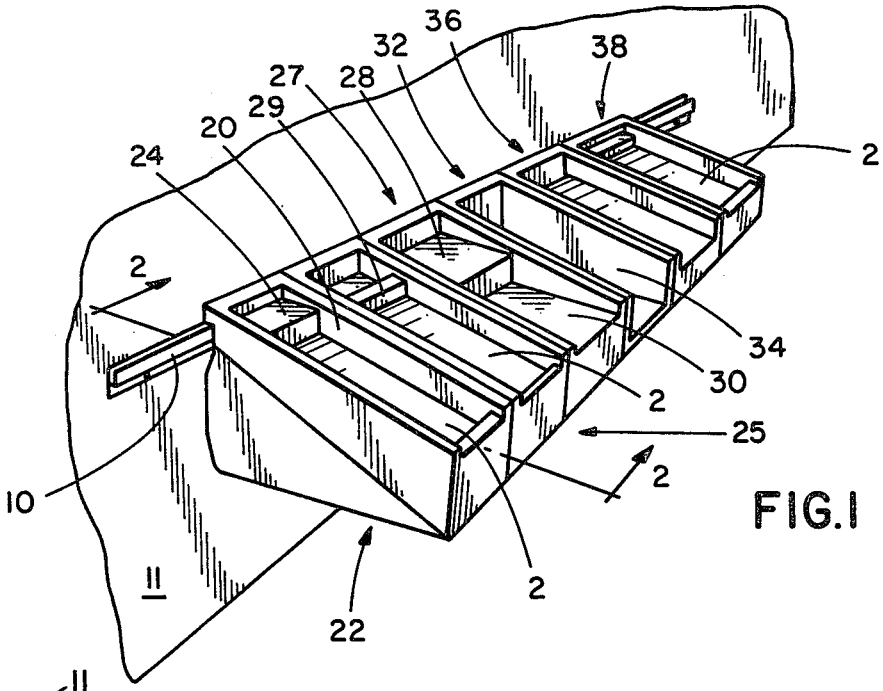
FIG. 1 is a perspective illustration of article modular supporting means in accordance with the invention showing how the supporting means may be formed in a number of different ways.

As stated, modular units in accordance with the invention can be formed in any number of ways, and in FIG. 1 a number of examples are shown. The upper surface 2 of a first unit 22 has one portion 24 which extends substantially horizontally from the wall in one plane while a second portion 26 extends at an angle to the wall in another plane. A second unit 25 has its upper surface 2 divided into two parts by means of a transverse divider 29. The upper surface of a third unit 27 has two surfaces 28 and 30 extending in different horizontal planes. In unit 32 the wall 34 does not extend completely around the unit when it might be desired to slide articles from the surface of the unit. Unit 36 is similar to unit 32 in that the wall does not extend completely around the unit, but in this case its upper surface 2 extends slightly downward from the back of the unit. Unit 38 illustrates how the dimensional relationship of an upper surface and two different planes may be modified as desired.

Figure 2:
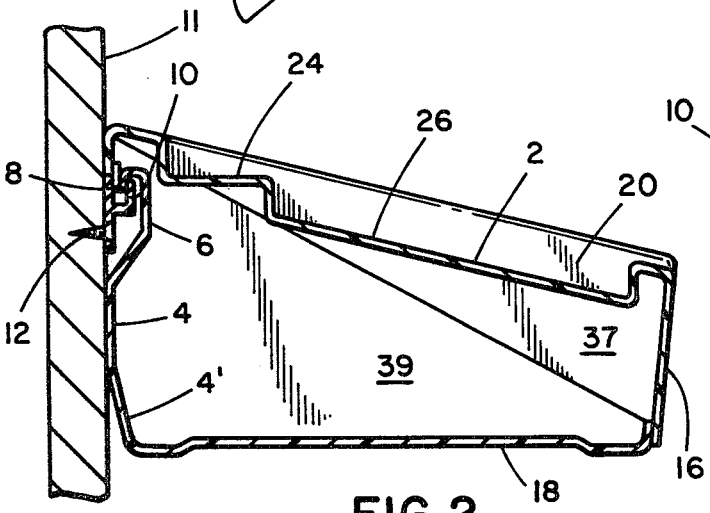
FIG. 2 is a view along the line 2—2 of FIG. 1.
Figure 3:
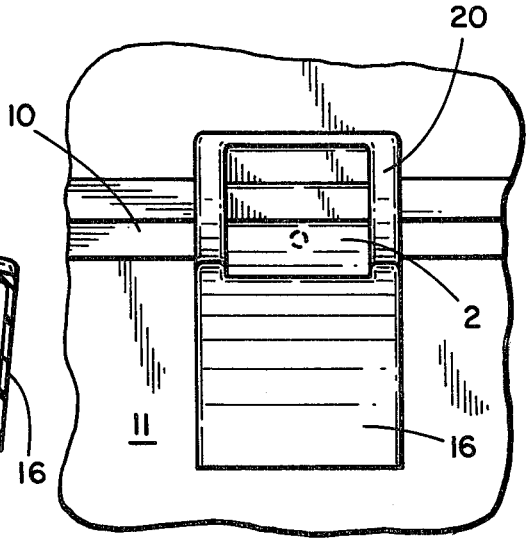
FIG. 3 is a front view of a modular unit in accordance with the invention.
Figure 4:
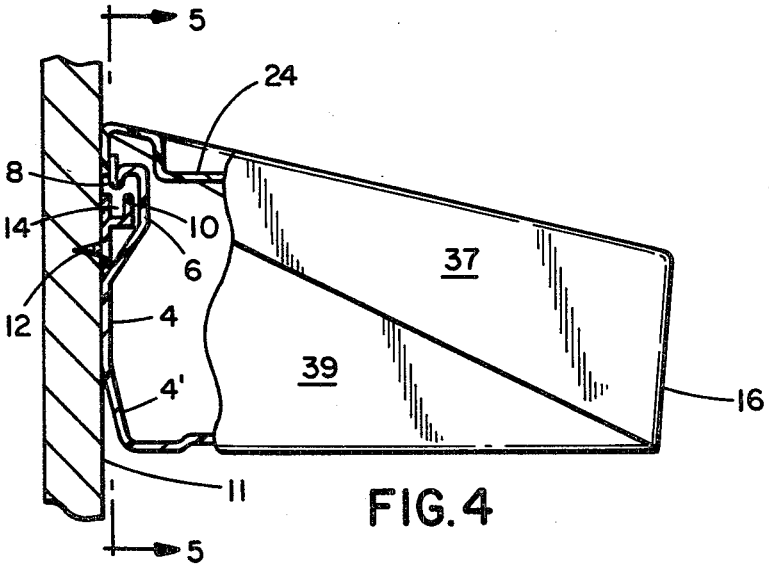
FIG. 4 is a side view partially in section of a modular unit in accordance with the invention.

As stated, the units are desirably formed by vacuum forming or injection molding and may be hollow so that they are lightweight yet rigid. To produce such units in an economical and efficient manner the units may be desirably formed of two pieces as indicated in FIGS. 2 and 4. An upper section indicated by the numeral 37 mates with a lower section indicated by numeral 39. The units may be joined by conventional techniques such as heat sealing, adhesive bonding and the like.

The overall dimensions of the units may be varied as the situation requires. For instance, they may be dimensioned so as it can be mounted in the space between the top of a kitchen counter and the bottom of cabinets which are usually above that counter and still provide access to the entire counter surface and articles stored on the units, whatever they may be. Units may be provided in accordance with the invention wherein their top surface is a cover which may be removed whereby the unit becomes a canister or container for holding various articles; for instance, food products such as flour, coffee or sugar. This it is contemplated that modular units in accordance with the invention may have a large variety of shapes, depending upon the purpose and the environment in which they are to be used.

It is intended by the claims appended hereto to cover all modifications and embodiments which come within their scope.

What is claimed as new and desired to be secured by Letters Patent is:

1. An article supporting unit for mounting on a vertically extending surface constituted by an upper section having an upper surface for the support of articles and a bottom extending downwardly to the horizontal and a lower section having a top extending downwardly from the horizontal, and said upper and lower sections are joined along their respective bottoms and tops to form a hollow construction wherein said upper surface is the top thereof and said hollow construction has a back surface extending downwardly from said upper surface, and wherein said back surface has a recess formed therein and a tongue extending downwardly over a portion of said recess whereby said tongue may engage in an upwardly opening channel in an element on the vertically extending surface and a portion of said element will be disposed in said recess.

2. Article supporting means as set forth in claim 1 comprising a plurality of article supporting units.

3. Article supporting means as set forth in claim 1, including means dividing said upper surface into two distinct parts.

4. Article supporting means as set forth in claim 3 wherein each said unit is provided with retaining walls extending above said upper surface.

5. Article supporting means as set forth in claim 4 wherein each said unit is provided with a front surface extending downwardly from said upper surface spaced from a substantially parallel to said back surface.

6. An article supporting unit as set forth in claim 1 wherein said back surface is provided with portions above and below said recess extending in substantially the same vertical plane.

7. Article supporting means as set forth in claim 6 comprising a plurality of article supporting units.

8. An article supporting unit for mounting on a vertically extending surface constituted by an upper section having an upper surface for the support of articles and a lower section having a bottom with side walls extending upwardly therefrom around the periphery thereof, and wherein said upper section has side walls corresponding to the side walls of said bottom section extending downwardly from said upper surface and joined with the side walls of said bottom section at their tops to form a hollow construction wherein said upper surface is the top thereof and said hollow construction has a back surface constituted by the joined side walls of said upper and lower sections, and means on said back surface for engagement with an element on the vertically extending surface for supporting the unit thereon.

9. An article supporting unit as set forth in claim 8 wherein said side walls of said lower section include a rear side wall extending above said bottom, a first and relatively greater distance, a front side wall extending above said bottom, a second and relatively shorter distance, and side walls extending from each end of said rear side wall sloping downwardly to said first side walls, and wherein said side walls of said upper section corresponding to the side walls of said lower section extend downwardly from said upper surface and are joined with said side walls of said bottom section at their tops.

* * * * *